US008833760B2

(12) United States Patent
Suzuki et al.

(10) Patent No.: US 8,833,760 B2
(45) Date of Patent: Sep. 16, 2014

(54) IMAGE PROCESSING APPARATUS

(71) Applicants: Takashi Suzuki, Nagoya (JP); Tetsuya Okano, Anjo (JP)

(72) Inventors: Takashi Suzuki, Nagoya (JP); Tetsuya Okano, Anjo (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/728,620

(22) Filed: Dec. 27, 2012

(65) Prior Publication Data

US 2013/0168921 A1 Jul. 4, 2013

(30) Foreign Application Priority Data

Dec. 28, 2011 (JP) ..... 2011-287653

(51) Int. Cl.
*G03G 15/00* (2006.01)
*B65H 85/00* (2006.01)

(52) U.S. Cl.
CPC ..... *B65H 85/00* (2013.01); *G03G 2215/00599* (2013.01); *G03G 15/6564* (2013.01); *G03G 2215/00603* (2013.01); *G03G 15/5008* (2013.01); *Y10S 271/902* (2013.01)
USPC ..... 271/225; 271/270; 271/902; 399/68; 399/401

(58) Field of Classification Search
USPC ..... 271/225, 270, 902; 399/396, 401, 67, 399/68, 320
See application file for complete search history.

(56) References Cited

U.S. PATENT DOCUMENTS 4,931,834 A * 6/1990 Suga ..... 399/75
6,539,189 B2 * 3/2003 Yanagida ..... 399/167
6,615,005 B2 * 9/2003 Maruyama ..... 399/67
7,274,903 B2 * 9/2007 Carter et al. ..... 399/320
7,588,242 B1 * 9/2009 Reidhaar ..... 271/3.14
8,141,871 B2 * 3/2012 Nakazawa ..... 271/256
8,155,560 B2 * 4/2012 Sahara ..... 399/122
8,282,092 B2 * 10/2012 Yasui et al. ..... 271/9.01
8,483,584 B2 * 7/2013 Dan ..... 399/31
2002/0003968 A1 1/2002 Maruyama
2003/0170048 A1 * 9/2003 Ahn ..... 399/167
2006/0093419 A1 * 5/2006 Kitamura ..... 399/401
2010/0003042 A1 1/2010 Dan
2010/0289210 A1 11/2010 Nakazawa
2012/0014731 A1 * 1/2012 Yasui et al. ..... 399/396

FOREIGN PATENT DOCUMENTS

JP 2001-310852 A 11/2001
JP 2010-014817 A 1/2010
JP 2010-264628 A 11/2010

* cited by examiner

*Primary Examiner* — Jeremy R Severson
(74) *Attorney, Agent, or Firm* — Scully, Scott, Murphy & Presser, P.C.

(57) ABSTRACT

An image processing apparatus includes: a motor for driving a first rotary body and a second rotary body that rotates according to an image processing operation; a switching unit that switches a connection/disconnection of the motor and the second rotary body; and a control unit that performs: a constant-speed rotation process of rotating the motor at a first speed in the connection state; a disconnecting process of performing switching to the disconnection state during the constant-speed rotation process; a decelerating process of decelerating the motor to a second speed after the disconnecting process; and a connecting process of performing, before completion of the decelerating process, switching to the connection state when the rotating speed of the second rotary body at a timing when the decelerating process is performed is slower than that at a timing when the switching to the disconnection state is performed in the disconnecting process.

14 Claims, 13 Drawing Sheets

IMAGE PROCESSING APPARATUS

CROSS-REFERENCE TO RELATED APPLICATIONS

This application claims priority from Japanese Patent Application No. 2011-287653 filed on Dec. 28, 2011, the entire subject matter of which is incorporated herein by reference.

TECHNICAL FIELD

The present invention relates to an image processing apparatus which uses a sheet to process an image. More specifically, the present invention relates to an image processing apparatus having an opportunity to reduce a conveyance speed of a sheet which is an image processing object.

BACKGROUND

There have been proposed image processing apparatuses which perform image processing using sheets, such as printing of images onto sheets or reading images on the sheets, and have an opportunity to decelerate sheet conveyance. For example, there have been proposed a printing apparatus capable of automatic duplex printing and having a mechanism for reversing a conveyance direction of a sheet having been subjected to simplex printing and inverting the sheet. In this case, the sheet is suspended in order to reverse the sheet conveyance direction, so that the sheet decelerates.

SUMMARY

However, the above-described image processing apparatuses have the following problem. The image processing apparatuses having an opportunity to decelerate sheet conveyance decrease a sheet conveyance speed to a target speed, and then proceeds to the next operation. Therefore, in order to reduce a time necessary for image processing, it is desirable to complete the deceleration of the sheet conveyance early. For this reason, there is a room for improvement in controlling sheet conveyance.

Therefore, illustrative aspects of the present invention provide an image processing apparatus capable of completing deceleration of sheet conveyance early.

According to one illustrative aspect of the invention, there is provided an image processing apparatus comprising: an image processing unit configured to perform image processing on a sheet; a first rotary body configured to convey the sheet; a second rotary body configured to rotate according to an image processing operation of the image processing unit; a motor that becomes a driving source of the first rotary body and the second rotary body; a switching unit configured to switch between a connection state where a driving force from the motor is transmitted to the second rotary body and a disconnection state where the driving force from the motor is not transmitted to the second rotary body; and a control unit. The control unit is configured to perform: a constant-speed rotation process of rotating the motor at a first speed in the connection state; a disconnecting process of performing switching to the disconnection state during the constant-speed rotation process; a decelerating process of decelerating the motor to a second speed that is slower than the first speed, wherein the decelerating process is performed after the disconnecting process; and a connecting process of performing switching to the connection state when the rotating speed of the second rotary body at a timing when the decelerating process is performed is slower than the rotating speed of the second rotary body at a timing when the switching to the disconnection state is performed in the disconnecting process, wherein the connecting process is performed after the disconnecting process and before completion of the decelerating process.

The image processing apparatus includes a connecting unit configured to switch between a connection state where the driving force from the motor is transmitted to the second rotary body and a disconnection state where the driving force from the motor is not transmitted to the second rotary body. On the occasion of decelerating the motor rotating at a constant speed in the connection state, first, during the constant-speed rotation process, switching to the disconnection state is performed. After the switching to the disconnection state, the decelerating process is performed to start deceleration of the motor. The decelerating process may be a process of decreasing the speed to a predetermined speed, or may be a process of stopping the motor (e.g., the second speed may be zero). Further, after the switching to the disconnection state, during the decelerating process, the image processing apparatus of the present invention performs switching to the connection state at a timing such that the rotating speed of the second rotary body at a timing when the decelerating process is performed is slower than the rotating speed of the second rotary body at the timing when the switching to the disconnection state was performed.

That is, in the image processing apparatus of the present invention, before the deceleration of the motor starts, first, switching to the disconnection state is performed to block the transmission of the driving force to the second rotary body. Therefore, the rotating speed of the second rotary body naturally decreases to be slower than the rotating speed (control speed) when the driving force from the motor is transmitted. Thereafter, in order to decelerate the motor, switching to the connection state is performed in a state where there is a rotating speed difference between a current rotating speed and the control speed with respect to the second rotary body.

According to the law of conservation of momentum, the motor decelerates and the second rotary body accelerates. In other words, the second rotary body becomes a load against the rotation of the motor. This promotes the deceleration of the motor. As a result, the time required for the motor to become the second speed is reduced as compared to a case of only the natural deceleration.

According to the illustrative aspects of the present invention, it is possible to implement an image processing apparatus which completes deceleration of sheet conveyance early.

DETAILED DESCRIPTION

Hereinafter, exemplary embodiments of the present invention will be described in detail with reference to the accompanying drawings. The exemplary embodiment was obtained by applying the present invention to an electrophotographic color printer having an opportunity to decelerate sheet conveyance.

[Configuration of Printer]

Figure 1:
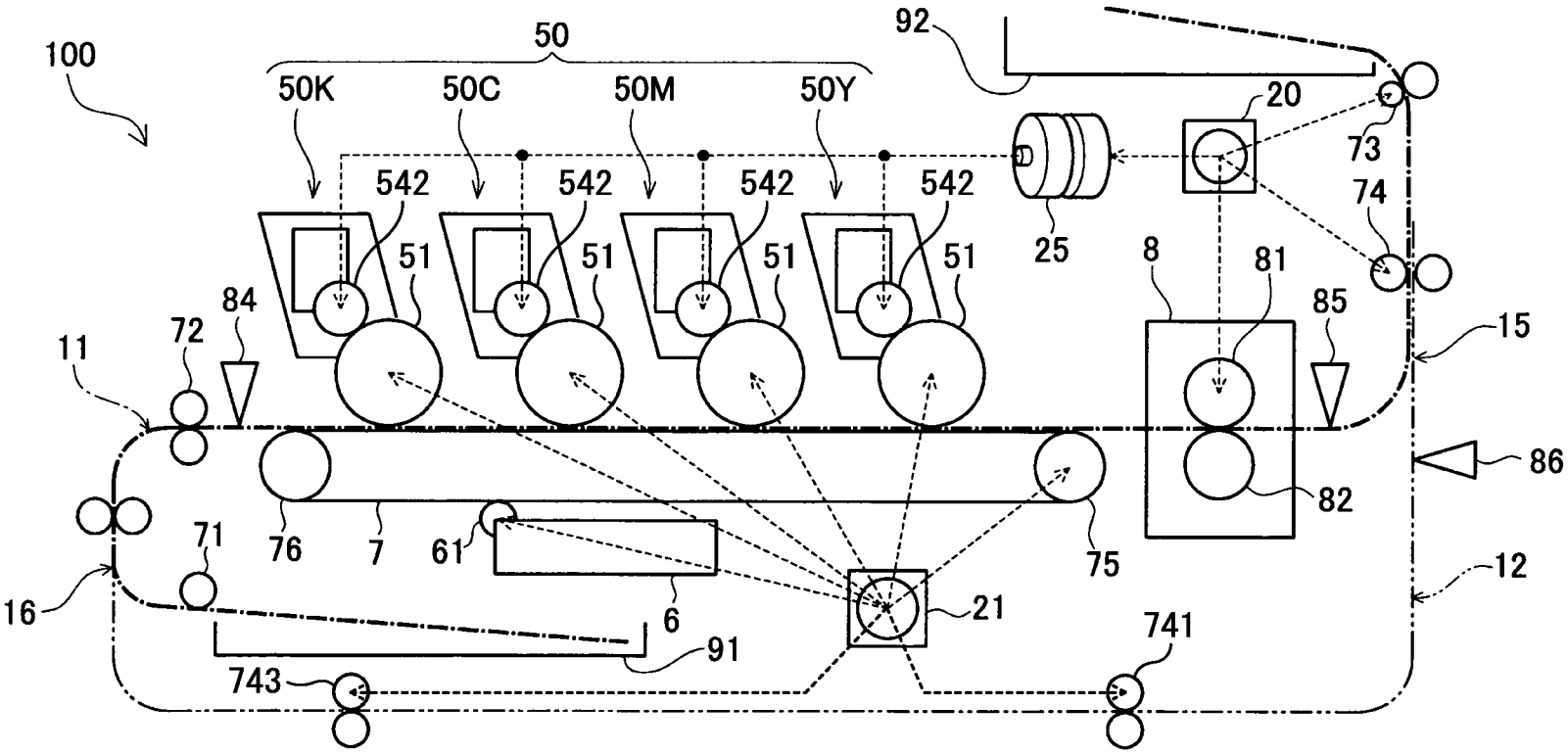
FIG. 1 is a conceptual view illustrating an internal configuration of a printer according to an exemplary embodiment.

As shown in FIG. 1, a printer 100 according to the present exemplary embodiment includes a processing unit 50 (one example of an image processing unit) configured to form a toner image and transfer the toner image onto a sheet so as to form the toner image on the sheet, a fixing unit 8 configured to fix the unfixed toner on the sheet to the sheet, a sheet cassette 91 configured to accommodate unprinted sheets, and a discharge tray 92 configured to for loading printed sheets.

Also, the printer 100 includes a substantially S-shaped conveyance path 11 (an alternate long and short dash line in FIG. 1) such that each sheet contained in the sheet cassette 91 positioned at the bottom is guided to the upper discharge tray 92 through a sheet feeding roller 71, registration rollers 72, the processing unit 50, the fixing unit 8, carriage rollers 74, and discharging rollers 73 (one example of a first rotary body).

Sensors for detecting whether there is any sheet are disposed on the conveyance path 11. Specifically, in the printer 100, on the upstream side of the processing unit 50 in a sheet conveyance direction, a sensor 84 is disposed downstream of the registration rollers 72, and on the downstream side of the fixing unit 8 in the sheet conveyance direction, a sensor 85 is disposed upstream of the carriage rollers 74. The printer 100 can detect that a sheet has passed the registration rollers 72 by the sensor 84, and thus can estimate a timing when the sheet is conveyed into the processing unit 50 on the basis of the detection timing. Further, the printer 100 can detect that a sheet has passed the fixing unit 8 by the sensor 85.

The processing unit 50 is configured to form color images. The processing unit 50 includes processing sections, which correspond to colors of yellow (Y), magenta (M), cyan (C), and black (K) and are arranged in parallel. Specifically, the processing unit 50 of the printer 100 includes a processing section 50Y configured to form yellow images, a processing section 50M configured to form magenta images, a processing section 50C configured to form cyan images, and a processing section 50K configured to form black images. The processing sections 50K, 50Y, 50M, and 50C are configured to form toner images by a known electrophotographic system. The order of the processing sections is not limited thereto.

Further, the processing unit 50 includes a conveyance belt 7 configured to convey sheets to the transfer positions of the processing sections 50Y, 50M, 50C, and 50K, and a cleaner 6 configured to remove toner attached to the conveyance belt 7. The conveyance belt 7 is an endless belt which is stretched over a driving roller 75 and a driven roller 76. The cleaner 6 includes a cleaning roller 61 configured to mechanically or electrically remove toner attached to the conveyance belt 7.

Figure 2:
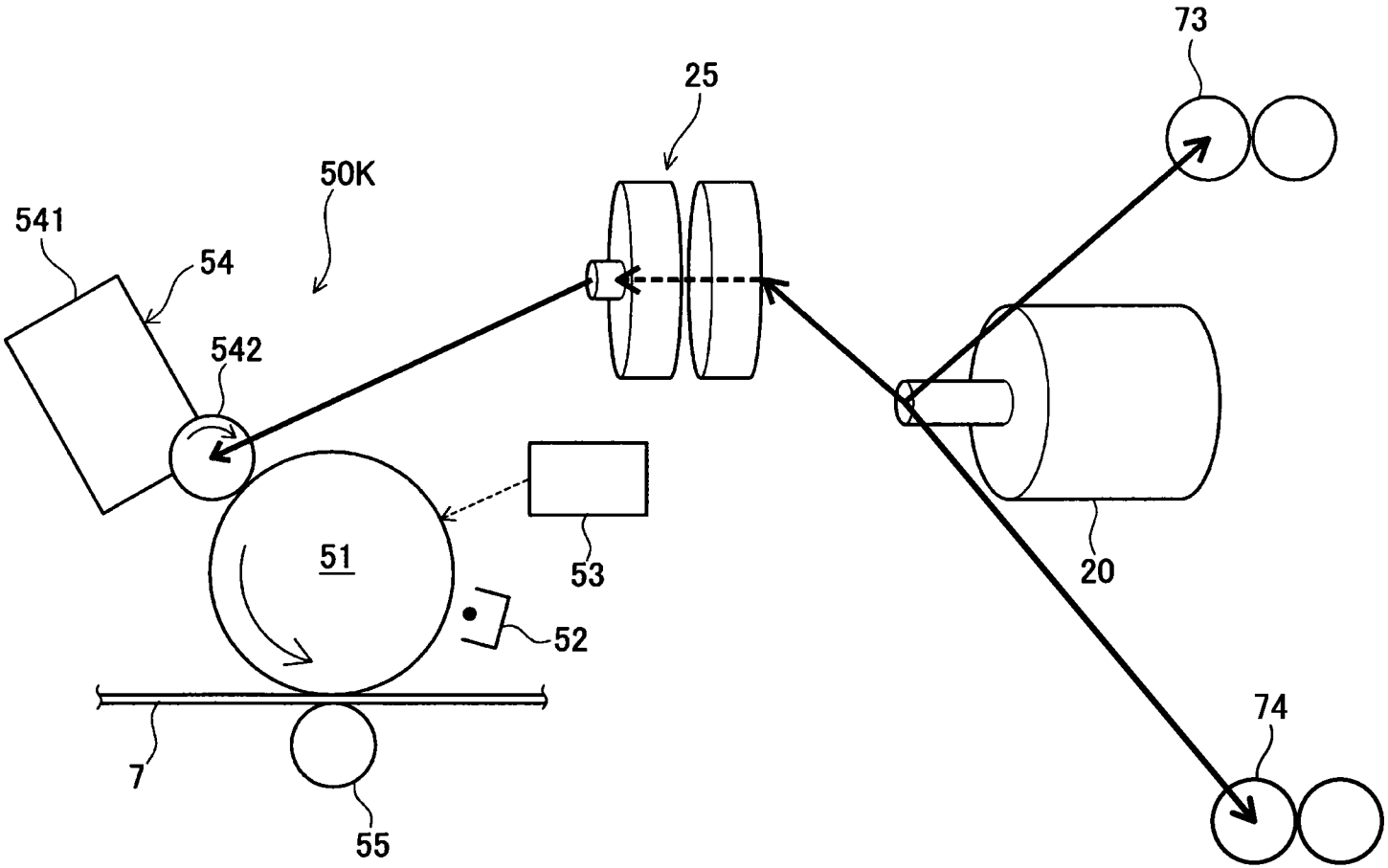
FIG. 2 is a view illustrating a schematic configuration of a driving-force transmitting path of the printer according to the exemplary embodiment.

FIG. 2 shows the schematic configuration of the processing section 50K. The processing section 50K includes a drum-like photosensitive element 51, a charging unit 52 configured to uniformly charge the surface of the photosensitive element 51, an exposing unit 53 configured to irradiate the photosensitive element 51 with light so as to form an electrostatic latent image, a developing unit 54 configured to develop the electrostatic latent image with toner so as to form a toner image, and a transferring unit 55 configured to transfer the toner image on the photosensitive element 51 onto a sheet. The photosensitive element 51 and the transferring unit 55 are disposed to be in contact with the conveyance belt 7. Further, the photosensitive element 51 faces the transferring unit 55 with the conveyance belt 7 interposed therebetween. The other processing sections 50C, 50M, and 50Y have the same configuration as that of the processing section 50K.

The developing unit 54 includes a container 541 configured to contains toner, and a developing roller 542 (one example of a second rotary body) that faces the photosensitive element 51 and is configured to convey the toner in the container 541 to the photosensitive element 51. The developing roller 542 is provided to be freely pressed against and separated from the photosensitive element 51. The developing roller 542 is controlled such that the developing roller 542 is pressed against the photosensitive element 51 during printing, and is separated from the photosensitive element 51 during cleaning of the photosensitive element 51.

As shown in FIG. 1, the fixing unit 8 includes a heating roller 81 (one example of a fixing roller) that is rotated while being heated, and a pressing roller 82 that is pressed against the heating roller 81 and rotates according to the rotation of the heating roller 81. The printer 100 makes each sheet pass through a nip portion between the heating roller 81 and the pressing roller 82 such that unfixed toner on the sheet is fixed to the sheet.

As shown in FIGS. 1 and 2, the printer 100 includes a first motor 20 (one example of a motor) and a second motor 21 which are driving sources of various rotary members in the printer 100. Specifically, in the present exemplary embodiment, a driving force from the first motor 20 is transmitted to the developing rollers 542 of the processing sections 50K, 50C, 50M, and 50Y, the heating rollers 81, the carriage rollers 74, and the discharging rollers 73. The driving force from the first motor is transmitted to, for example, feeding rollers configured to feed the toner to the developing rollers 542, and agitators configured to agitate toner accumulated in the containers 541. A driving force from the second motor 21 is transmitted to the photosensitive elements 51, the driving rollers 75 of the processing sections 50K, 50C, 50M, and 50Y, and the cleaning rollers 61. The driving force from the second motor is transmitted to carriage rollers 741 and 743 disposed in the re-conveyance path 12.

The printer 100 further includes an electromagnetic clutch 25 (one example of a switching unit) that is positioned between the first motor 20 and the developing rollers 542 on a driving-force transmitting path of the first motor 20. The electromagnetic clutch 25 is configured to switch between a state where the electromagnetic clutch 25 transmits the driving force (hereinafter, referred to as a connection state) and a state where the electromagnetic clutch 25 does not transmit the driving force (hereinafter, referred to as a disconnection state). In a case where the electromagnetic clutch 25 is in the connection state, the developing rollers 542 are rotated by the first motor 20.

The above-described printer 100 is configured to take out a sheet loaded in the sheet cassette 91, convey the sheet to the processing unit 50 where a toner image is formed, and transfer the toner image onto the sheet. The sheet having the transferred toner image thereon is conveyed to the fixing unit 8 where the toner image is thermally fixed to the sheet. Then, the sheet is discharged to the discharge tray 92.

Further, the printer 100 performs a correction-value acquiring process when a predetermined condition is satisfied (for example, the number of times of printing is a predetermined number of times or more). In the correction-value acquiring process, a test image is transferred onto the conveyance belt 7, and a correlation value for image correction is acquired on the basis of a timing when the test image is detected. After the correction-value acquiring process, the cleaner 6 on the conveyance belt 7 recovers the toner (test image) on the conveyance belt 7. That is, during printing, the cleaner 6 separates the cleaning roller 61 from the conveyance belt 7 so as to prevent the cleaning roller from having an influence on sheet conveyance, and after the test, the cleaner 6 presses the cleaning roller 61 against the conveyance belt 7 to recover the toner. After the recovery, the cleaner 6 separates the cleaning roller 61 from the conveyance belt 7 again so as to prevent the cleaning roller from having an influence on sheet conveyance.

The printer 100 includes a duplex printing mechanism for performing printing on both sides of a sheet. A re-conveyance path 12 (an alternate long and two short dashes line in FIG. 1) of FIG. 1 is a conveyance path for inverting a sheet having been subjected to simplex printing on one side and re-conveys the sheet to the processing unit 50 such that printing can be performed on the back of the sheet (hereinafter, a side on which printing is performed earlier is referred to as 'one side' (one example of a first side) and a side on which printing is performed later is referred to as 'the other side' (one example of a second side)). The re-conveyance path 12 branches from the conveyance path 11 at a position on the downstream side of the fixing unit 8 in the sheet conveyance direction (hereinafter, the branching position from the conveyance path 11 is referred to as a branch point 15), passes under the sheet cassette 91, and merges into the conveyance path 11 at a position on the upstream of the processing unit 50 (hereinafter, the merging position into the conveyance path 11 is referred to as a merging point 16).

Specifically, in the duplex printing of the printer 100, a sheet is inverted in the following procedure. First, after a trailing end of a sheet having been subjected to simplex printing on one side through the conveyance path 11 passes the branch point 15, in a state where the sheet having been subjected to simplex printing is interposed between the discharging rollers 73 (that is, a state immediately before the sheet is discharged), the conveyance of the sheet is suspended. Thereafter, the rotation directions of the discharging rollers 73 and the carriage rollers 74 are reversed such that the conveyance direction of the sheet is reversed and the sheet having been subjected to simplex printing is introduced into the re-conveyance path 12. Next, on the upstream side of the processing unit 50 of the conveyance path 11, the sheet having been subjected to simplex printing returns to the conveyance path 11. After the sheet is introduced into the re-conveyance path 12, the rotation directions of the discharging rollers 73 and the carriage rollers 74 return to the original directions. In this way, the front and rear of the sheet are inverted such that printing on the other side becomes possible. Incidentally, the mechanism for inverting a sheet is not limited to this example. Any general mechanisms for implementing duplex printing can be applied.

Further, in the printer 100, a sensor, which is configured to detect whether there is any sheet, is also disposed on the re-conveyance path 12. In the present exemplary embodiment, a sensor 86 is disposed on the downstream side of the branch point 15 in the sheet conveyance direction of the inverted sheet. The printer 100 can detect whether any sheet has been introduced into the re-conveyance path 12 by the sensor 86.

[Electrical Configuration of Printer]

Figure 3:
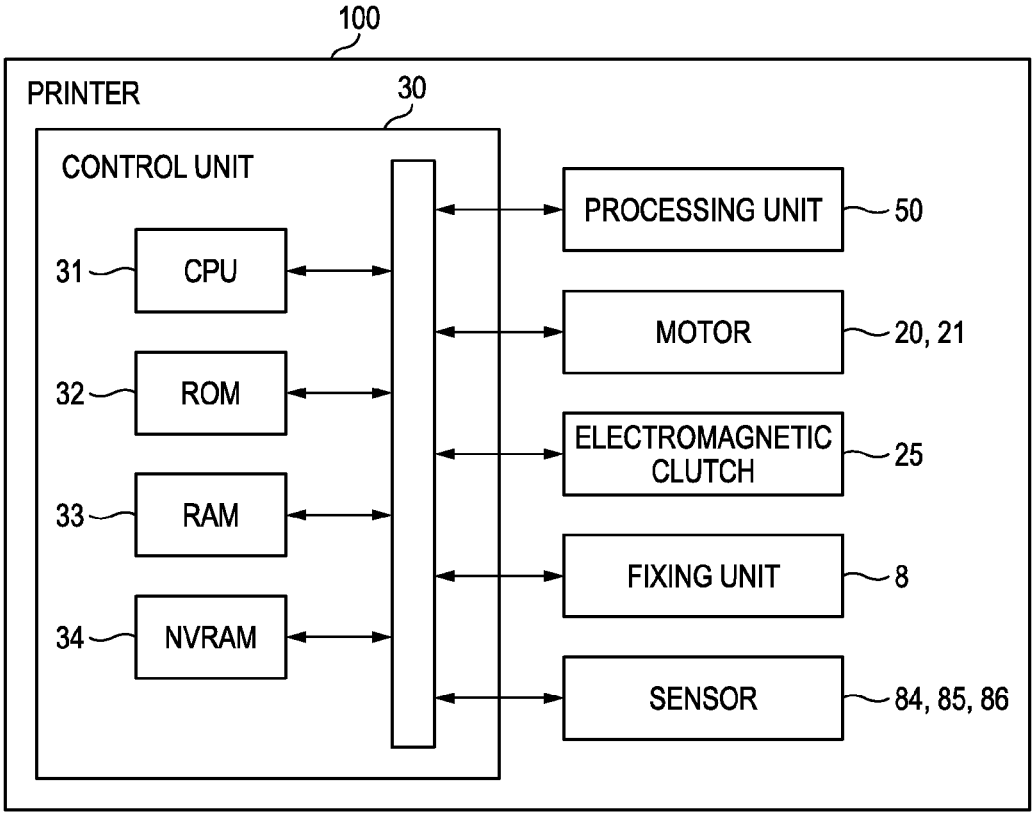
FIG. 3 is a block diagram illustrating an electrical configuration of the printer according to the exemplary embodiment.

Subsequently, the electrical configuration of the printer 100 will be described. As shown in FIG. 3, the printer 100 includes a control unit 30 including a CPU 31, a ROM 32, a RAM 33, and an NVRAM (non-volatile RAM) 34. Further, the control unit 30 is electrically connected to the processing unit 50, the first motor 20, the second motor 21, the electromagnetic clutch 25, the fixing unit 8, the sensors 84 to 86, and so on.

The ROM 32 is configured to store various control programs for controlling the printer 100, various options, initial values, and so on. The RAM 33 is used as a work area into which various control programs are read, or as a storage area for temporarily storing image data.

The CPU 31 is configured to store process results in the RAM 33 or the NVRAM 34 according to control programs read from the ROM 32 and signals transmitted from various sensors, and control each component of the printer 100. The sheet conveying process to be described below is also controlled by the CPU 31.

[Sheet Conveyance Control]

Subsequently, as a process having an opportunity to decelerate sheet conveyance in the printer 100, two examples will be described.

A first example is a sheet conveying process in a case of dealing with a duplex print job. In duplex printing, when the conveyance direction of the sheet having been subjected to simplex printing is reversed, there is an opportunity to suspend the conveyance of the sheet. In order to suspend the conveyance of the sheet, the sheet conveyance decelerates.

A second example is a sheet conveying process in a case where there is a difference in the type of sheet between a prior job and the next job. That is, depending on the combination of the types of sheet of the prior job and the next job, printing of the next job may be performed with a conveyance speed lower than that of the prior job (for example, the type of sheet of the prior job is plain paper, and the type of sheet of the next job is thick paper). In this case, before the conveyance of the next job starts, the sheet conveyance decelerates.

First Example

Figure 4A:
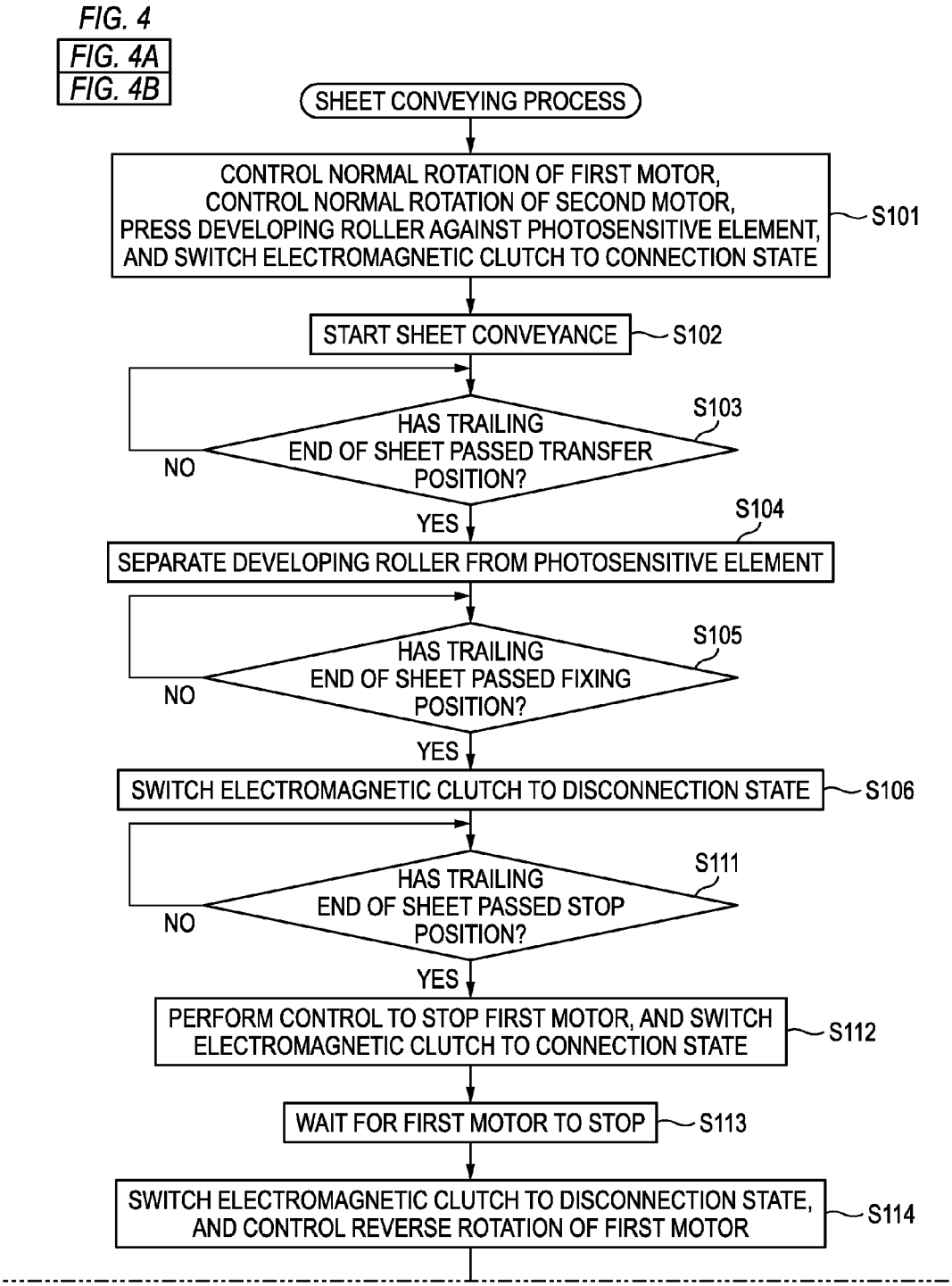
FIGS. 4A and 4B are flow charts illustrating a procedure of a sheet conveying process according to a first example.
Figure 4B:
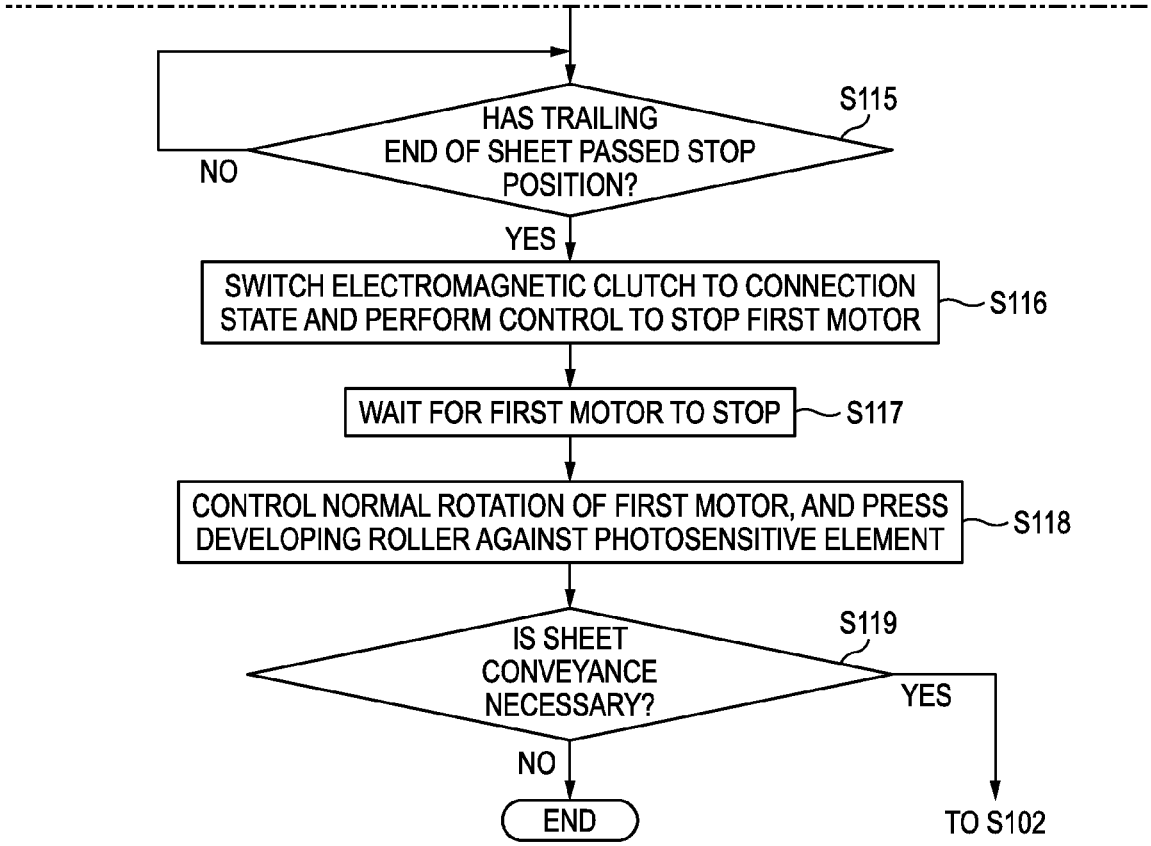

First, as the first example, a sheet conveying process in a case of performing duplex printing will be described with reference to the flow chart of FIG. 4 and the timing chart of FIG. 5. In response of a performance start instruction of a print job, the sheet conveying process is performed by the control unit 30.

In the sheet conveying process of the first example, first, in STEP S101 (one example of a constant-speed rotation process), control for the constant-speed rotation of the first motor 20 in a normal rotation direction starts. Also, in STEP 5101, control on the constant-speed rotation of the second motor 21 in a normal rotation direction starts. Further, in STEP 5101, the developing rollers 542 are pressed against the photosensitive elements 51, and the electromagnetic clutch 25 switches to the connection state. Therefore, the driving force from the first motor 20 is transmitted to the developing rollers 542 such that the developing rollers 542 rotate at a constant speed.

After STEP S101, in STEP S102, sheet conveyance starts. That is, sheets in the sheet cassette 91 are introduced into the conveyance path 11 one at a time, and the sheets are conveyed into the processing unit 50. When a sheet passes through the processing unit, the processing unit 50 transfers a toner image onto the sheet so as to form the toner image on the sheet. The sheet having been subjected to simplex printing through the processing unit 50 is conveyed to the fixing unit 8 such that the unfixed toner is fixed to the sheet.

After STEP S102, in STEP S103, it is determined whether the trailing end of the sheet has passed a final transfer position in the processing unit (that is, it is determined whether image processing on the sheet by the developing rollers 542 is completed). For example, the passage of the transfer position may be surmised according to an elapsed time from a time point when the trailing end of the sheet has been detected by the sensor 84 that is positioned on the upstream side of the processing unit 50. In a case where the trailing end of the sheet has not passed the transfer position (NO in STEP S103), the control unit waits for the trailing end of the sheet to pass the transfer position.

In a case where the trailing end of the sheet has passed the transfer position (YES in STEP S103), in STEP S104, the developing rollers 542 are separated from the photosensitive elements 51. Since the trailing end of the sheet has passed the transfer position, separation of the developing rollers 542 from the photosensitive elements has no influence on the printing on the sheet.

Next, in STEP S105, it is determined whether the trailing end of the sheet has passed a fixing position (that is, it is determined whether image processing on the sheet by the heating roller 81 is completed). For example, the passage of the fixing position may be determined by detection of the trailing end of the sheet by the sensor 85 positioned downstream of the fixing unit 8. In a case where the trailing end of the sheet has not passed the fixing position (NO in STEP S105), the control unit waits for the trailing end of the sheet to pass the fixing position.

In a case where the trailing end of the sheet has passed the fixing position (YES in STEP S105), in STEP S106 (one example of a disconnecting process), the electromagnetic clutch 25 switches to the disconnection state. The timing of STEP S105 corresponds to the position of 'DISCONNECTING PROCESS' in FIG. 5. Due to the disconnecting process, the transmission of the driving force to the developing rollers 542 is blocked, such that the developing rollers 542 start to decelerate. Incidentally, since the developing rollers 542 are separate from the photosensitive elements 51, even if the speed of the developing rollers 542 changes, problems such as friction according to a rotating speed difference does not occur.

After STEP S106, in STEP S111, it is determined whether the trailing end of the sheet has passed a stop position. Here, the stop position means a position for suspending the sheet conveyance to invert and reversely convey the sheet, and becomes a position where the trailing end of the sheet has passed the branch point 15 but has not passed the discharging rollers 73. For example, the passage of the stop position can be surmised according to an elapsed time from the time point when the trailing end of the sheet has been detected by the sensor 85. Incidentally, in a working example, after a stop command is output to the first motor 20 driving the discharging rollers 73, it takes a time for the first motor 20 to completely stop, so that it is difficult for the sheet to stop immediately after passing the stop position. For this reason, the stop position assures a distance from the discharging rollers 73 in view of a conveyance distance to stop the first motor 20. In a case where the trailing end of the sheet has not passed the stop position (NO in STEP S111), the control unit waits for the trailing end of the sheet to pass the stop position.

In a case where the trailing end of the sheet has passed the stop position (YES in STEP S111), in STEP S112 (one example of the decelerating process), control to stop the first motor 20 starts. Specifically, the control unit interrupts the power supply to the first motor 20, and waits for natural stop. Further, in STEP 5112, in association with the start of the control to stop the first motor 20 (e.g., at the same time as the start of the control to stop the first motor 20), the control unit returns the electromagnetic clutch 25 to the connection state (one example of a connecting process).

Figure 5:
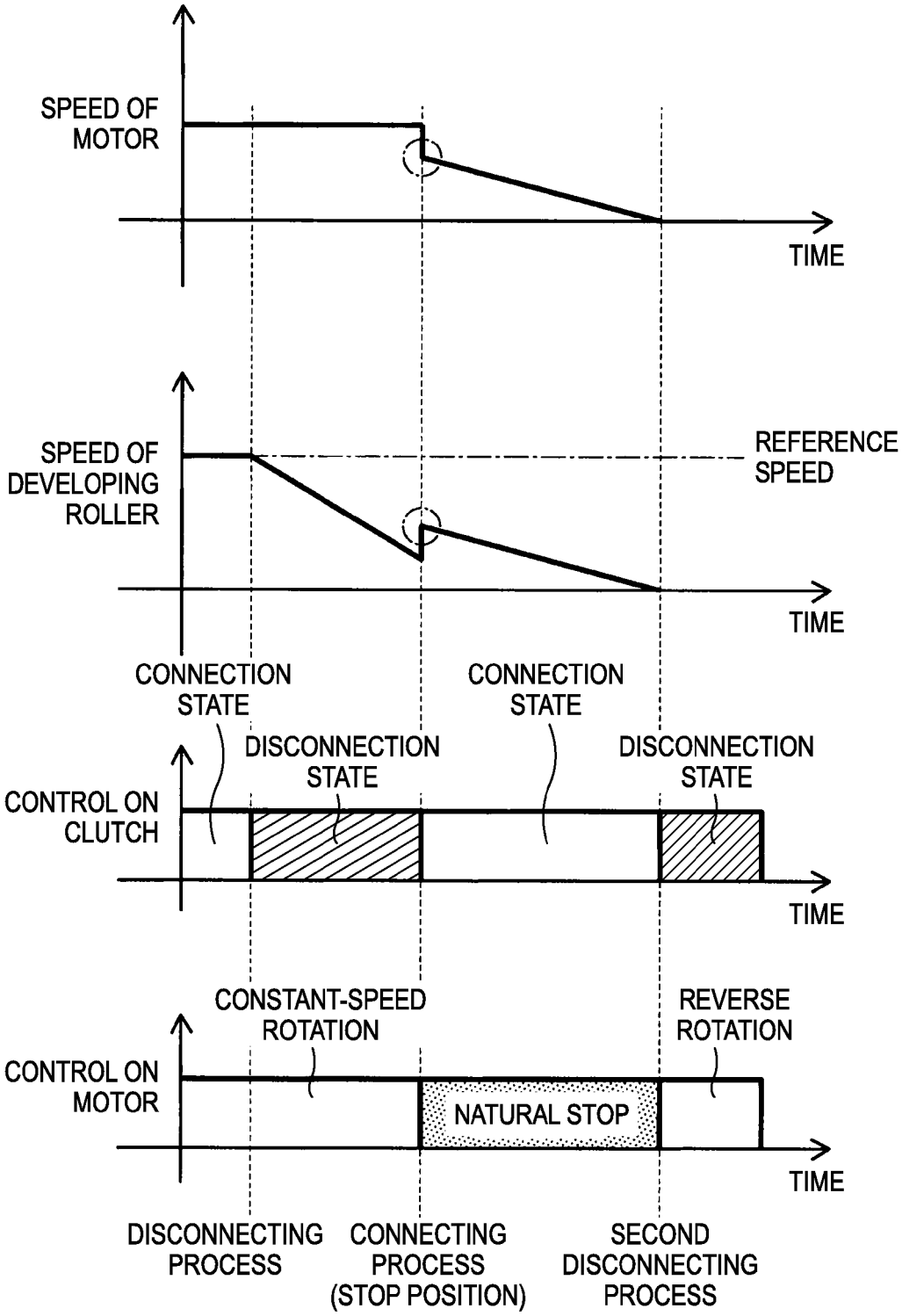
FIG. 5 is a timing chart illustrating a relation among a speed of a motor, a speed of developing rollers, control on a clutch, and control on the motor according to the first example.

The timing of STEP S112 corresponds to the position of 'CONNECTING PROCESS' in FIG. 5. At this position (stop position), the control to stop the first motor 20 starts such that the first motor 20 starts to decelerate. When the control to stop the first motor 20 starts, the control unit returns the electromagnetic clutch 25 to the connection state such that the first motor 20 is connected to the developing rollers 542 having been decelerating. As a result, according to the law of conservation of momentum, the first motor 20 decelerates and the developing rollers 542 accelerate. In other words, the developing rollers 542 become a load on the first motor 20 such that the first motor 20 rapidly decelerates, and the developing rollers 542 accelerate.

After STEP S112, in STEP S113, the control unit waits for the first motor 20 to stop. When the first motor 20 stops, the discharging rollers 73 and the carriage rollers 74 stop with the sheet interposed between the discharging rollers 73. When the first motor 20 stops, the electromagnetic clutch 25 finishes the role as the load on the first motor 20. Therefore, in STEP 5114 (one example of a second disconnecting process), the electromagnetic clutch 25 switches to the disconnection state again. Further, since the rotation of the first motor 20 has stopped, in STEP S114, the control for the constant-speed rotation of the first motor 20 in a reverse rotation direction starts (one example of a reverse rotation process). As a result, the discharging rollers 73 and the carriage rollers 74 rotate reversely. Then, the sheet interposed between the discharging rollers 73 is introduced into the re-conveyance path 12, and returns to the conveyance path 11 through the merging point 16. Incidentally, the timing of STEP S114 corresponds to the position of 'SECOND DISCONNECTING PROCESS' in FIG. 5.

After STEP S114, in STEP S115, it is determined whether the trailing end of the sheet has passed the stop position. In this case, the trailing end is the opposite end portion to the end portion of the sheet detected in STEP S111 in the sheet conveyance direction. For example, the passage of the stop position can be surmised by detection of the trailing end of the sheet by the sensor 86. In a case where the trailing end of the sheet has not passed the stop position (NO in STEP S115), the control unit waits for the trailing end of the sheet to pass the stop position.

In a case where the trailing end of the sheet has passed the stop position (YES in STEP S115), in STEP S116, control to stop the first motor 20 starts. That is, after the sheet is introduced into the re-conveyance path 12, the sheet is conveyed by the carriage rollers 741 and 743 driven by the second motor 21. Meanwhile, in order to discharge the sheet having been subjected to the printing on the other side, the discharging rollers 73 and the carriage rollers 74 rotating reversely need to return to the normal rotation. To this end, the first motor 20 stops. In STEP S116, at the same time as the start of the control to stop the first motor 20, the control unit returns the electromagnetic clutch 25 to the connection state. Therefore, like in STEP S112, the developing rollers 542 hasten the deceleration of the first motor 20.

After STEP S116, in STEP S117, the control unit waits for the first motor 20 to stop. After the first motor 20 stops, in order to perform the same operation as that during the simplex printing, in STEP S118, control for the constant-speed rotation in the normal rotation direction starts, and after a target speed is reached, the developing rollers 542 are pressed against the photosensitive elements 51. Therefore, printing in the processing unit 50 becomes possible. Then, the sheet having subjected to the printing on the other side is discharged by the discharging rollers 73.

After STEP S118, in STEP S119, it is determined whether conveyance of the next sheet is necessary. If conveyance of the next sheet is necessary (YES in STEP S119), the control unit returns to STEP S102 to continue the sheet conveyance. On the other hand, if conveyance of the next sheet is not necessary (NO in STEP S119), the control unit finishes the sheet conveying process.

In the first example, as shown in FIG. 5, before the first motor 20 stops, switching to the disconnection state is performed for decelerating the developing rollers 542, so as to naturally decrease the rotating speed of the developing rollers 542 to be slower than the rotating speed (control speed) thereof when the driving force from the first motor 20 is transmitted until the sheet reaches the stop position. Then, in order to stop the first motor 20, the switching to the connection state is performed such that the developing rollers 542 are used as the load. Therefore, the speed of the first motor 20 decreases rapidly. As a result, the first motor 20 stops earlier.

Figure 6:
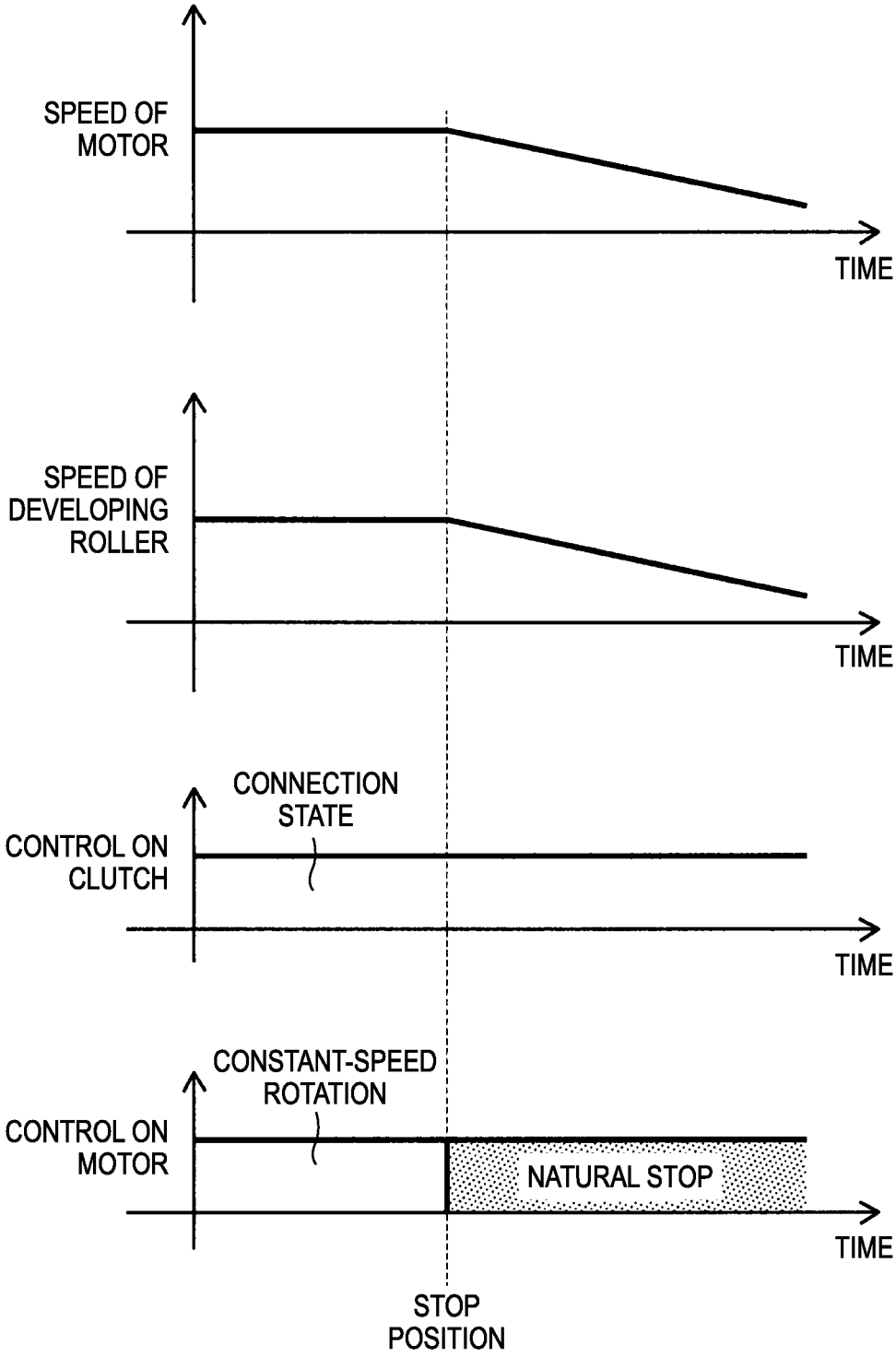
FIG. 6 is a timing chart illustrating a relation among the speed of the motor, the speed of developing rollers, control on the clutch, and control on the motor according to a related-art example.

The timing chart of FIG. 6 shows an example (that is, a related-art example) in which the developing rollers 542 do not decelerate until the first motor 20 stops. In this case, since the developing rollers 542 rotate at the rotating speed (control speed) when the driving force from the first motor 20 is transmitted, the speed of the deceleration of the first motor 20 is the same as the speed of the deceleration of the first example after the rapid deceleration according to the connecting process. Therefore, unlike the first example, in the related-art example, since there is no rapid deceleration, the first motor 20 stops late. Needless to say, in the related-art example, if the electromagnetic clutch 25 switches to the disconnection state at the same time as the start of the control to stop the first motor 20, even a load for rotating the developing rollers 542 is eliminated. Therefore, the speed of the deceleration of the first motor 20 becomes slow, and the first motor 20 stops later.

Incidentally, in the first example, after the disconnecting process prior to the start of the control to stop the first motor 20, the connecting process is performed at the same time as the start of the control to stop the first motor 20. However, the performance timing of the connecting process is not limited thereto. The performance timing of the connecting process may be set such that, in the stage of starting the control to stop the first motor 20, the rotating speed of the developing rollers 542 is slower than the rotating speed of the developing rollers 542 during the constant-speed rotation of the first motor 20 (hereinafter, referred to as a reference speed, and corresponding to the value of 'REFERENCE SPEED' of FIG. 5).

Figure 7:
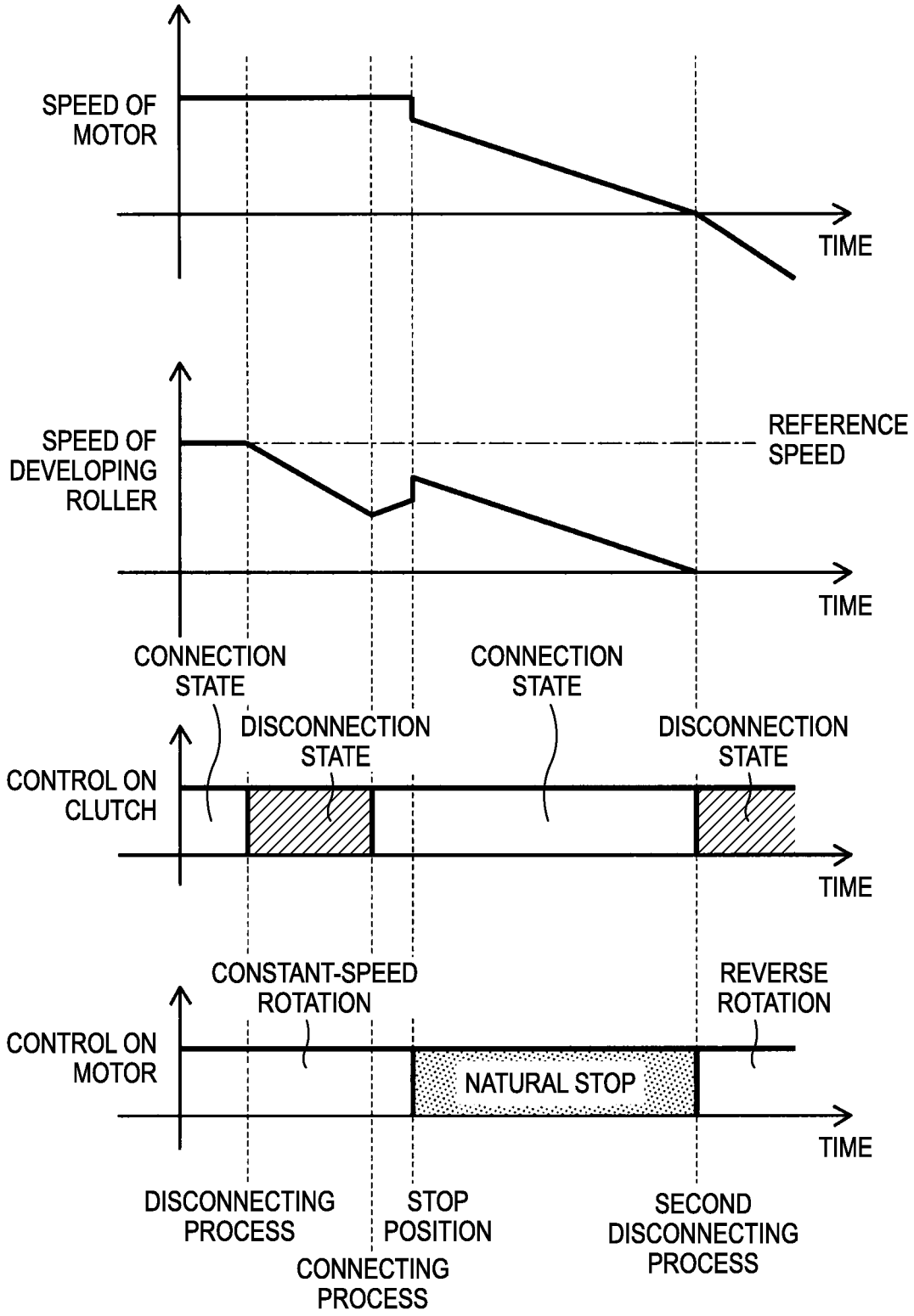
FIG. 7 is a timing chart illustrating a relation among the speed of a motor, the speed of developing rollers, control on a clutch, and control on the motor according to an application.

For example, as shown in FIG. 7, as long as the rotating speed of the developing rollers 542 do not reach the reference speed at the stage of starting the control to stop the first motor 20 ('STOP POSITION' in FIG. 7), the performance timing of the connecting process may be before the control to stop the first motor 20 starts. That is, as long as the rotating speed of the developing rollers 542 is different from the reference speed at the stage of starting the control to stop the first motor 20, the developing rollers 542 become the load on the first motor 20 in order to reduce the speed difference.

Figure 8:
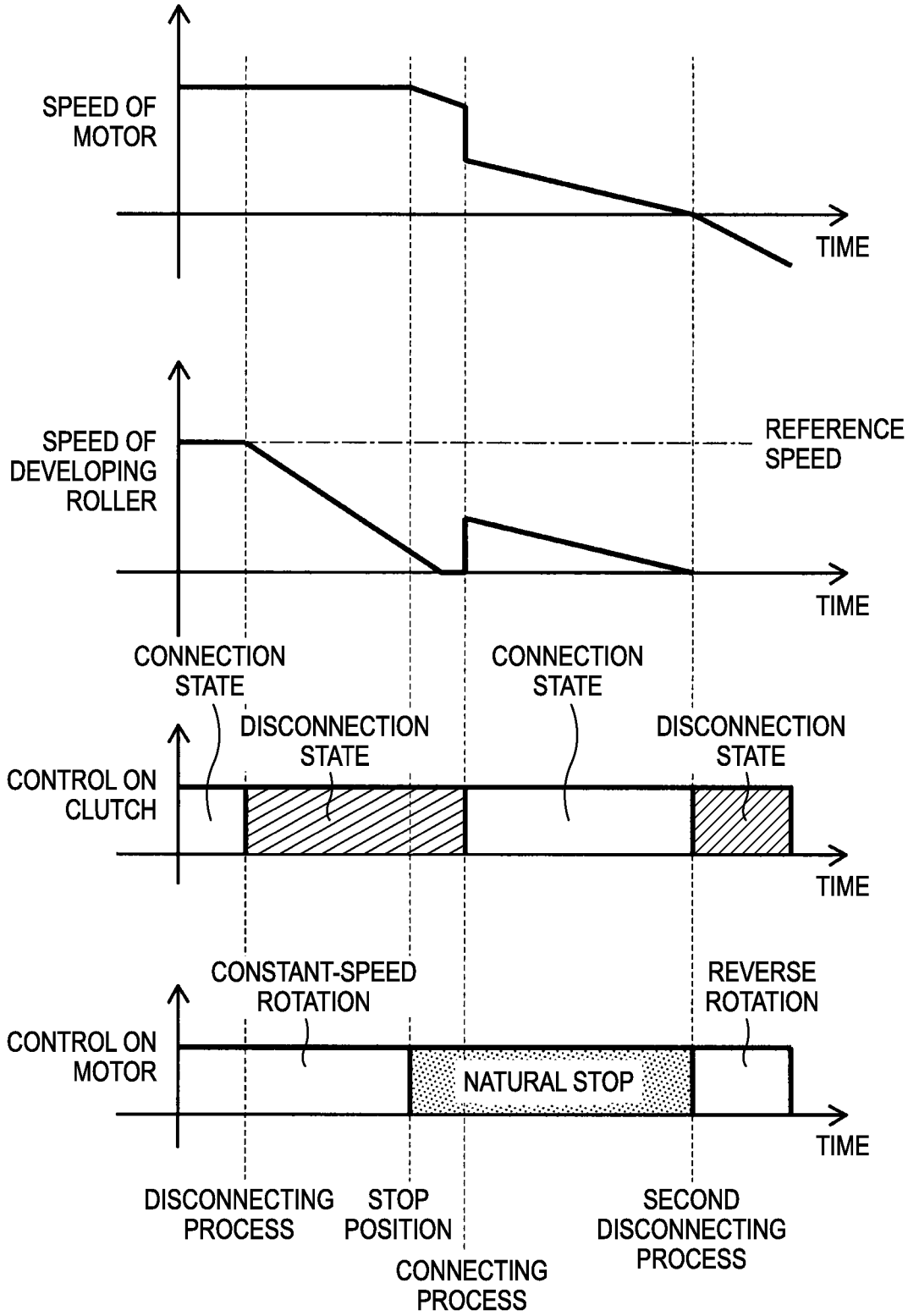
FIG. 8 is a timing chart illustrating a relation among the speed of a motor, the speed of developing rollers, control on a clutch, and control on the motor according to another application.

Further, as shown in FIG. 8, the performance timing of the connecting process may be after the start of the control to stop the first motor 20. If the performance timing of the connecting process is after the start of the control to stop the first motor 20, at the stage of starting the control to stop the first motor 20 ('STOP POSITION' in FIG. 8), the rotating speed of the developing rollers 542 is slower than the reference speed. Therefore, at the performance timing of the connecting process, the rotating speed of the developing rollers 542 is different from the reference speed, and the developing rollers 542 become the load on the first motor 20 to reduce the speed difference.

Incidentally, in the case where the performance timing of the connecting process is after the start of the control to stop the first motor 20, the following points are considered. That is, in performing the connecting process, if the first motor 20 is still, connection with the developing rollers 542 is pointless. For this reason, the performance timing of the connecting process is at least before the first motor 20 stops. Further, in the disconnection state, if the speed of the deceleration of the first motor 20 is faster than the speed of the deceleration of the developing rollers 542, the rotating speed of the first motor 20 becomes slower than the rotating speed of the developing rollers 542. In this case, the connecting process is not performed.

The performance timing of the connecting process may be set such that, the rotating speed of the developing rollers 542 is slower than the reference speed at the stage of starting the control to stop the first motor 20. Incidentally, in order for the developing rollers 542 to produce maximum deceleration effect, it may be preferable to set the performance timing of the connecting process to a timing when the developing rollers 542 stop (for example, the state of FIG. 8). On the other hand, if the developing rollers 542 stop, in a case where the developing rollers 542 are in contact with other rotary members, the friction with the other rotary members increases. For example, in a case of performing this process without separating the developing rollers 542 from the photosensitive elements 51, the friction between the developing rollers 542 and the photosensitive elements 51 increases. Also, if the deceleration effect is too strong, a load may be applied on a gear. For this reason, for both of early completion of the deceleration and the life of the product, it may be preferable to perform switching to the connection state before the second rotary bodies stop.

Second Example

Figure 9A:
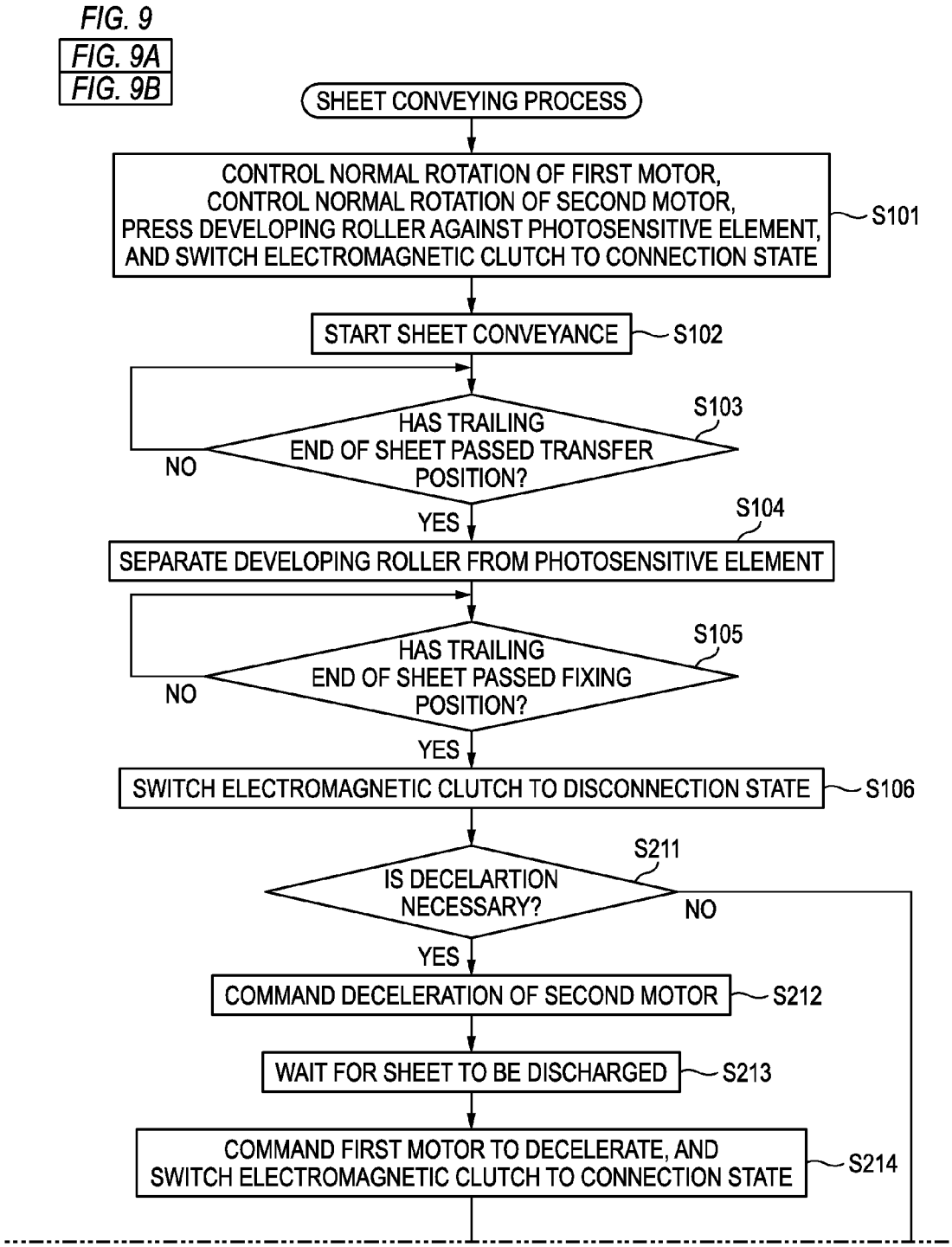
FIGS. 9A and 9B are flow charts illustrating a procedure of a sheet conveying process according to a second example.
Figure 9B:
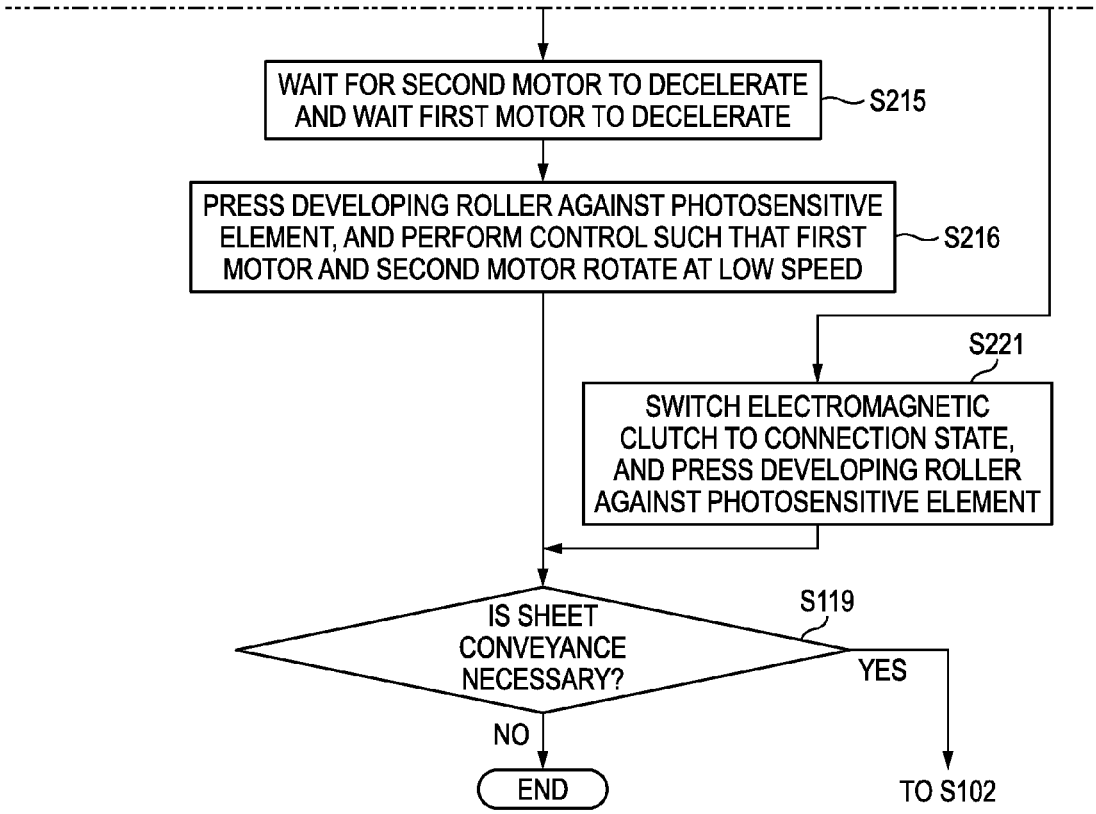

Next, as a second example, a sheet conveying process in a case where a prior job uses plain paper and the next job uses thick paper will be described with reference to the flow chart of FIG. 9. In response of a start instruction for print job performance, the sheet conveying process is performed by the control unit 30.

From when the trailing end of a prior sheet passes the fixing portion to when the electromagnetic clutch 25 switches to the connection state, the sheet conveying process of the second example is the same as the sheet conveyance control of the first motor, so that the detail description thereof will be omitted.

After STEP S106, in STEP S211, it is determined whether it is necessary to decelerate the sheet conveyance. In STEP S211, paper of the prior sheet is compared to paper of the next sheet, and if a conveyance speed required by the next sheet is slower than a conveyance speed required by the prior sheet, it is determined that the deceleration is necessary. For example, in a case where the prior sheet is plain paper and the next sheet is thick paper, it is determined that the deceleration is necessary. If the deceleration is unnecessary (NO in STEP S211), in STEP S221, the electromagnetic clutch 25 returns to the connection state, and the developing rollers 542 are pressed against the photosensitive elements 51. Next, the control unit proceeds to STEP S119.

If the deceleration is necessary (YES in STEP S211), first, in STEP S212, the control unit outputs a deceleration command to the second motor 21. After the prior sheet passes the fixing portion, the sheet passes a position having no relation with the second motor 21 (that is, a position where the driving force from the second motor 21 has no influence on the conveyance of the sheet). Therefore, it is possible to instruct the second motor 21 to change the speed earlier than the first motor 20.

After STEP S212, in STEP S213, the control unit waits for the prior sheet to be discharged. After the prior sheet is discharged, the driving force from the first motor 20 has no influence on the sheet conveyance. Until the prior sheet is discharged, the second motor 21 decelerates earlier than the first motor 20 does.

After STEP S213, in STEP S214 (one example of the decelerating process), control to decelerate the first motor 20 starts. Also, in STEP S214, the electromagnetic clutch 25 returns to the connection state in association with (e.g., at the same time as) the start of the control to decelerate the first motor 20 (one example of the connecting process). Therefore, like in STEP S112 of the first example, in order to reduce the speed difference between the developing rollers 542 and the first motor 20, the developing rollers 542 become the load on the first motor 20 such that the first motor decelerates rapidly, and the developing rollers 542 accelerate. That is, a time to when the first motor 20 decelerates becomes shorter.

After STEP S214, in STEP S215, the control unit waits for the first motor 20 and the second motor 21 to decelerate to a low speed (a speed required for conveyance of the next sheet). After the required speed is reached, in STEP S216 (one example of a low-speed process), the developing rollers 542 are pressed against the photosensitive elements 51, and control for rotation of the first motor 20 and the second motor 21 at low constant speed starts. Therefore, low-speed conveyance becomes possible, and the thick paper is allowed to be introduced into the conveyance path 11.

After STEP S216, or in the case where the deceleration is unnecessary (NO in STEP S211), in STEP S119, it is determined whether conveyance of the next sheet is necessary. If conveyance of the next sheet is necessary (YES in STEP S119), the control unit returns to STEP S102 so as to continue the sheet conveyance. On the other hand, if conveyance of the next sheet is not necessary (NO in STEP S119), the control unit finishes the sheet conveying process.

As described above, in the second example, like in the first example, before the first motor 20 decelerates, switching to the disconnection state is performed for decelerating the developing rollers 542 decelerate, so as to decrease the rotating speed of the developing rollers 542 to be slower than the rotating speed (control speed) thereof when the driving force from the first motor 20 is transmitted. In order for the first motor 20 to decelerate, switching to the connection state is performed such that the developing rollers 542 are used as the load. Therefore, the speed of the first motor 20 decreases rapidly. As a result, the deceleration of the first motor 20 to a target speed is hastened.

Figure 10:
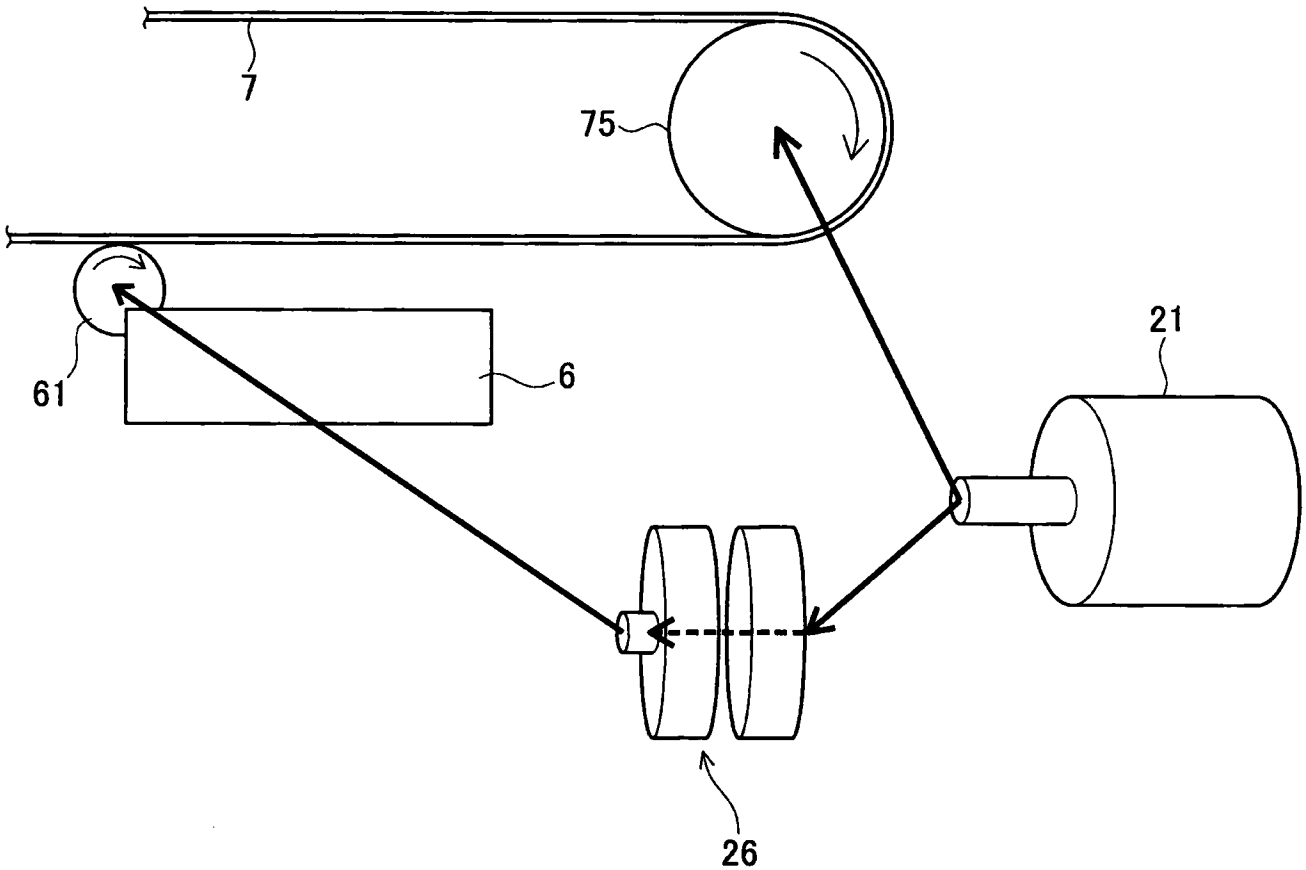
FIG. 10 is a view illustrating a schematic configuration of a driving-force transmitting path of a printer according to the second example.

Incidentally, in the second example, an electromagnetic clutch for hastening the deceleration of the second motor 21 may be provided. For example, as shown in FIG. 10, an electromagnetic clutch 26 is provided on a driving-force transmitting path between the second motor 21 and the cleaning roller 61. In this case, like when the first motor 20 decelerates, before the deceleration of the second motor 21 starts, the electromagnetic clutch 26 switches to the disconnection state, and in order to start the deceleration of the second motor 21, the electromagnetic clutch 26 switches to the connection state. In this way, like the first motor 20, it is possible to hasten the deceleration of the second motor 21.

Third Example

Next, as a third example, an exemplary embodiment in which both of the developing rollers 542 and the pressing roller 82 are used as the second rotary body will be described.

Figure 11:
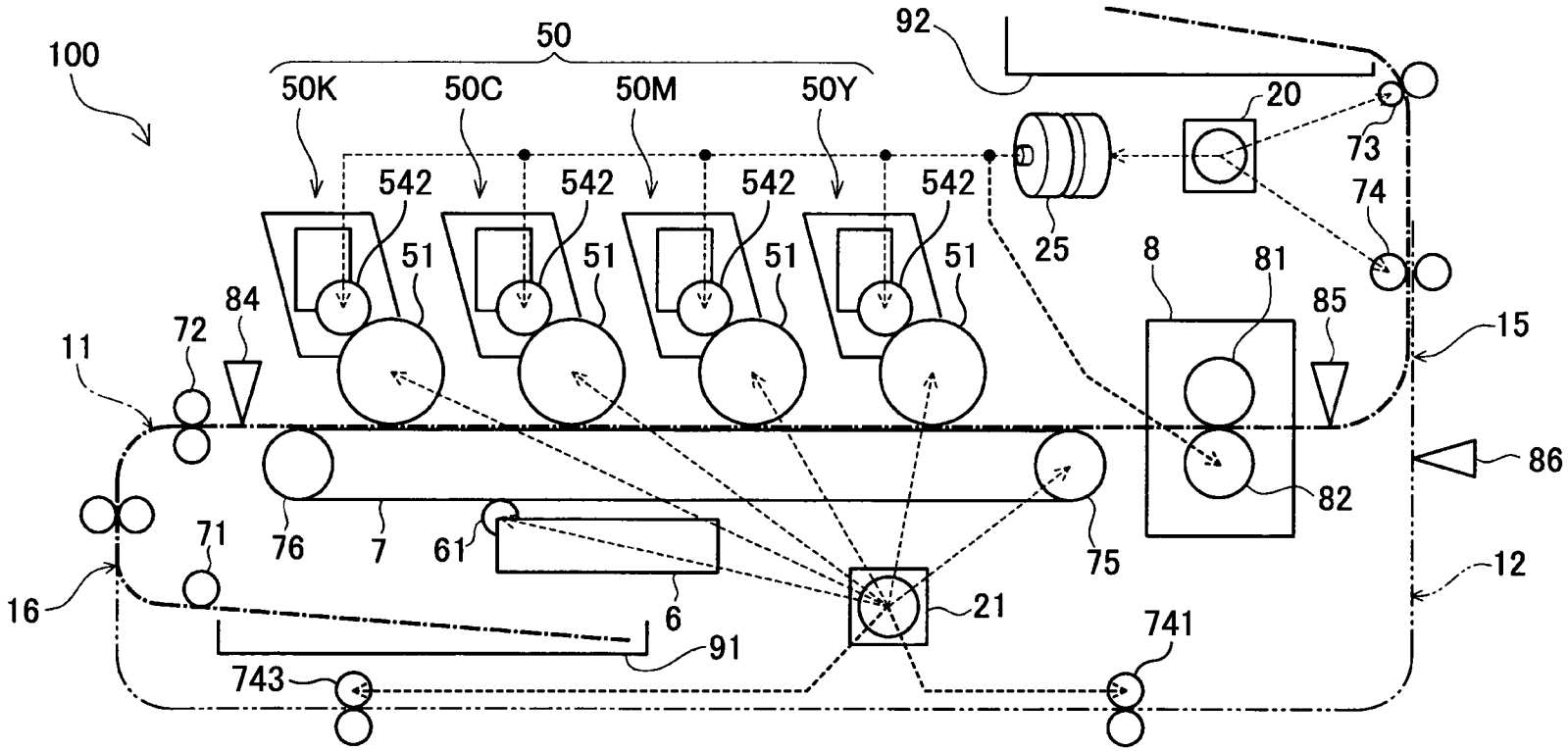
FIG. 11 is a conceptual view illustrating an internal configuration of a printer according to another exemplary embodiment.

In the third example, as shown in FIG. 11, the printer 100 includes the electromagnetic clutch 25 (one example of a switching unit) that is positioned between the first motor 20 and the developing rollers 542 or the first motor 20 and the pressing roller 82 on the driving-force transmitting path of the first motor 20. The electromagnetic clutch 25 is configured to switch between a state where the electromagnetic clutch 25 transmits the driving force (hereinafter, referred to as a connection state) and a state where the electromagnetic clutch 25 does not transmit the driving force (hereinafter, referred to as a disconnection state).

In the third example, in a case where the electromagnetic clutch 25 is in the connection state, the developing rollers 542 and the pressing roller 82 are rotated by the first motor 20. On the other hand, in a case where the electromagnetic clutch 25 is in the disconnection state, the developing rollers 542 and the pressing roller 82 are not driven by the first motor 20. That is, in this example, both of the developing rollers 542 and the pressing roller 82 are operated as the second rotary body.

In the third example, when the clutch 25 is switched to the disconnection state before the first motor 20 stops, both of the developing rollers 542 and the pressing roller 82 are decelerated, and the rotating speed of the developing rollers 542 and the pressing roller 82 becomes slower than the rotating speed (control speed) thereof when the driving force from the first motor 20 is transmitted. Then, by switching the electromagnetic clutch 25 to the connection state after the rotating speed of the developing rollers 542 and the pressing roller 82 becomes slower than the rotating speed thereof when the driving force from the first motor 20 is transmitted, both of the developing rollers 542 and the pressing roller 82 are used as the load for decreasing the speed of the first motor 20. That is, by using both of the developing rollers 542 and the pressing roller 82 as the load, the speed of the first motor 20 decreases rapidly. According thereto, as similar to the first example, the deceleration of the first motor 20 a target speed is hastened.

As described above, in the printer 100, before the deceleration of the first motor 20 starts, switching to the disconnection state is performed in advance, so that the transmission of the driving force to the developing rollers 542 is disconnected. Accordingly, the developing rollers 542 start to decelerate, and the rotating speed of the developing rollers 542 becomes slower than the rotating speed (control speed) when the driving force from the first motor 20 is transmitted. Thereafter, during the process of decelerating the first motor 20, the electromagnetic clutch returns to the connection state. Therefore, in order to reduce the speed difference according to the law of conservation of momentum, the developing rollers 542 become the load on the rotation of the first motor 20. This promotes the deceleration of the first motor 20. As a result, the time required for the first motor 20 to decelerate is reduced.

Incidentally, the above-described exemplary embodiments are merely examples and do not limit the present invention. The present invention can be improved and modified in various forms without departing from the scope. For example, the image forming system of the printer 100 is not limited to the electrophotographic system, but may be an inkjet system. Further, the printer 100 may be able to form color images, or may be dedicated for monochrome images.

The image processing apparatus may not be limited to the printer. The image processing apparatus may be applied to various apparatuses so long as they have an opportunity to decelerate sheet conveyance, and the image processing apparatus may be a scanner, a copy machine, a multi-function apparatus, or a FAX machine. For example, when the image forming apparatus is a scanner, the present invention can be applied to an automatic document feeder (ADF) for reading both sides of a sheet by inversion and reverse conveyance of the sheet. In the case of the ADF, the second rotary bodies correspond to, for example, carriage rollers for conveying a sheet during reading.

Further, in the above-described exemplary embodiments, when the electromagnetic clutch 25 is switched to the disconnection state, the developing rollers 542 are separated from the photosensitive elements 51. Alternatively, even if the developing rollers 542 are not separated from the photosensitive elements 51, the effect of the early deceleration of the first motor 20 is produced so long as the developing rollers 542 decelerate in the disconnection state. However, since the friction between the developing rollers 542 and the photosensitive elements 51 varies according to the deceleration of the developing rollers 542, for the life of the product, it may be preferable to separate the developing rollers 542 from the photosensitive elements 51.

Further, in the above-described exemplary embodiments, the electromagnetic clutch 25 is disposed between the first motor 20 and the developing rollers 542 on the driving-force transmitting path of the first motor 20, and the developing rollers 542 are used as the load on the first motor 20 in order to stop the first motor 20. However, the disposition of the electromagnetic clutch 25 is not limited thereto. For example, the electromagnetic clutch 25 may be disposed between the first motor 20 and the heating roller 81, and the heating roller 81 may be used as the load on the first motor 20.

According to another illustrative aspect of the present invention, the connecting process performs the switching to the connection state after the rotation of the second rotary body stops.

According thereto, the load which the second rotary body applies the motor during the deceleration of the motor is maximized. Therefore, for earlier completion of the deceleration, it is preferable to perform the switching to the connection state after the second rotary body stops.

According to still another illustrative aspect of the present invention, the connecting process performs the switching to the connection state before the rotation of the second rotary body stops.

If the rotating speed of the second rotary body becomes zero, it may be feared that the friction between the second rotary body and another member could vary to have a negative influence on the life of the second rotary body or another member. For this reason, for both of early completion of the deceleration and the life of the product, it is preferable to perform the switching to the connection state before the second rotary body completely stops.

According to still another illustrative aspect of the present invention, the disconnecting process performs the switching to the disconnection state after image processing on the sheet by the second rotary body is completed and before the decelerating process starts.

If the driving force to the second rotary body is blocked during image processing, a negative influence on the image processing is feared. For this reason, for both of early completion of the deceleration and maintenance of the image quality, it is preferable to perform the switching to the disconnection state after the image processing is completed.

According to still another illustrative aspect of the present invention, the connecting process performs the switching to the connection state in association with start of the decelerating process.

During the decelerating process, connection with second rotary body is always expected to promote the deceleration. However, in the state where the rotating speed is close to the second speed, even if the switching is performed, the effect may be small. Rather, excessive deceleration is feared. For this reason, in order to make it possible to surely expect early deceleration, it is preferable to perform the switching to the connection state at the same time as the start of the decelerating process.

According to still another illustrative aspect of the present invention, the decelerating process stops the rotation of the motor as the second speed. The control unit performs a reverse rotation process of reversely rotating the motor after the motor stops in the decelerating process.

According thereto, it is possible to hasten the start of the reverse rotation of the motor.

According to still another illustrative aspect of the present invention, the control unit performs a second disconnecting process of performing switching to the disconnection state after the switching to the connection state is performed in the connecting process.

During conveyance according to the reverse rotation, if even the second rotary body rotates, a negative influence on the second rotary body or another member is feared. For this reason, for the life of the product, it is preferable to block transmission of the driving force to the second rotary body.

According to still another illustrative aspect of the present invention, the second disconnecting process performs the switching to the disconnection state after the motor is decelerated to the second speed in the decelerating process.

In order to make it possible to surely expect early deceleration, it is preferable to maintain the connection state until the motor is decelerated to the second speed.

According to still another illustrative aspect of the present invention, the second disconnecting process performs the switching to the disconnection state before the reverse rotation process starts.

When the motor restarts to rotate, in order to make it possible to expect a reduction in the acceleration time of the motor, it is preferable to prevent the load of the second rotary body from being applied.

According to still another illustrative aspect of the present invention, after the motor is decelerated to the second speed in the decelerating process, the control unit performs a low-speed process of continuing the rotation of the motor at the second speed.

According thereto, it is possible to hasten the transition of the motor to a low speed.

According to still another illustrative aspect of the present invention, the image processing unit performs a process of forming an image on the sheet.

According to still another illustrative aspect of the present invention, the second rotary body is a developing roller, and the disconnecting process performs the switching to the disconnection state after the forming of the image on the sheet is completed.

According to still another illustrative aspect of the present invention, the second rotary body is a fixing roller, and the disconnecting process performs the switching to the disconnection state after the forming of the image on the sheet is completed and after a fixing operation of fixing the formed image to the sheet is completed.

According to still another illustrative aspect of the invention, there is provided an image forming apparatus comprising: a motor configured to provide a driving force; an image forming unit configured to form an image on a sheet and configured to be driven by the driving force from the motor; a conveying unit configured to convey the sheet through the image forming unit and configured to be driven by the driving force from the motor; a transmitting unit configured to transmit the driving force of the motor to the conveying unit; a switching unit configured to switch between a coupling state in which the switching unit couples the motor and the image forming unit to transmit the driving force from the motor to the image forming unit, and a decoupling state in which the switching unit decouples the motor and the image forming unit; and a control unit. The control unit is configured to: switch the switching unit to the coupling state, start rotating the motor in a first speed, and start forming an image on the sheet by the image forming unit; switch the switching unit from the coupling state to the decoupling state and keep rotating the motor in the first speed, after forming image on the sheet is finished; start decelerating the motor from the first speed to a second speed that is slower than the first speed; and switch the switching unit from the decoupling state to the coupling state after starting decelerating the motor from the first speed to the second speed.

According thereto, it is possible to implement an image processing apparatus which completes deceleration of sheet conveyance early.

What is claimed is:

1. An image processing apparatus comprising:

an image processing unit configured to perform image processing on a sheet;

a first rotary body configured to convey the sheet;

a second rotary body configured to rotate according to an image processing operation of the image processing unit;

a motor that becomes a driving source of the first rotary body and the second rotary body;

a switching unit configured to switch between a connection state where a driving force from the motor is transmitted to the second rotary body and a disconnection state where the driving force from the motor is not transmitted to the second rotary body; and a control unit configured to perform:

a constant-speed rotation process of rotating the motor at a first speed in the connection state;

a disconnecting process of performing switching to the disconnection state during the constant-speed rotation process;

a decelerating process of decelerating the motor to a second speed that is slower than the first speed, wherein the decelerating process is performed after the disconnecting process; and a connecting process of performing switching to the connection state when the rotating speed of the second rotary body at a timing when the decelerating process is performed is slower than the rotating speed of the second rotary body at a timing when the switching to the disconnection state is performed in the disconnecting process, wherein the connecting process is performed after the disconnecting process and before completion of the decelerating process.

2. The image processing apparatus according to claim 1, wherein the connecting process performs the switching to the connection state after the rotation of the second rotary body stops.

3. The image processing apparatus according to claim 1, wherein the connecting process performs the switching to the connection state before the rotation of the second rotary body stops.

4. The image processing apparatus according to claim 1, wherein the disconnecting process performs the switching to the disconnection state after image processing on the sheet by the second rotary body is completed and before the decelerating process starts.

5. The image processing apparatus according to claim 1, wherein the connecting process performs the switching to the connection state in association with start of the decelerating process.

6. The image processing apparatus according to claim 1, wherein the decelerating process stops the rotation of the motor as the second speed, and wherein the control unit performs a reverse rotation process of reversely rotating the motor after the motor stops in the decelerating process.

7. The image processing apparatus according to claim 6, wherein the control unit performs a second disconnecting process of performing switching to the disconnection state after the switching to the connection state is performed in the connecting process.

8. The image processing apparatus according to claim 7, wherein the second disconnecting process performs the switching to the disconnection state after the motor is decelerated to the second speed in the decelerating process.

9. The image processing apparatus according to claim 7, wherein the second disconnecting process performs the switching to the disconnection state before the reverse rotation process starts.

10. The image processing apparatus according to claim 1, wherein after the motor is decelerated to the second speed in the decelerating process, the control unit performs a low-speed process of continuing the rotation of the motor at the second speed.

11. The image processing apparatus according to claim 1, wherein the image processing unit performs a process of forming an image on the sheet.

12. The image processing apparatus according to claim 11, wherein the second rotary body is a developing roller, and wherein the disconnecting process performs the switching to the disconnection state after the forming of the image on the sheet is completed.

13. The image processing apparatus according to claim 11, wherein the second rotary body is a fixing roller, and wherein the disconnecting process performs the switching to the disconnection state after the forming of the image on the sheet is completed and after a fixing operation of fixing the formed image to the sheet is completed.

14. The image processing apparatus according to claim 11, wherein the second rotary body is a pressing roller, and wherein the disconnecting process performs the switching to the disconnection state after the forming of the image on the sheet is completed and after a fixing operation of the fixing the formed image to the sheet is completed.

* * * * *